US005409400A

United States Patent [19]

Davis

[11] Patent Number: 5,409,400

[45] Date of Patent: Apr. 25, 1995

[54] SHIELDING FOR AN ELECTRICAL CONNECTOR

[75] Inventor: Wayne S. Davis, Harrisburg, Pa.

[73] Assignee: The Whitaker Corporation, Wilmington, Del.

[21] Appl. No.: 239,154

[22] Filed: May 6, 1994

Related U.S. Application Data

[63] Continuation-in-part of Ser. No. 199,346, Jan. 16, 1994, which is a continuation of Ser. No. 4,859, Jan. 15, 1993, abandoned.

[51] Int. Cl.[6] ..... H01R 13/648

[52] U.S. Cl. ..... 439/610; 439/906

[58] Field of Search ..... 439/607, 609, 610, 680, 439/687, 696, 904, 906

[56] References Cited

U.S. PATENT DOCUMENTS

| | | | |
|---|---|---|---|
| 3,760,335 | 9/1973 | Roberts | 339/99 R |
| 4,921,441 | 5/1990 | Sauder | 439/610 |
| 5,158,481 | 10/1992 | Frantz | 439/607 |
| 5,162,000 | 11/1992 | Frantz | 439/607 |
| 5,199,903 | 4/1993 | Asick et al. | 439/610 |

*Primary Examiner*—Neil Abrams
*Assistant Examiner*—Hien D. Vu

[57] ABSTRACT

Shielding for an electrical connector comprises, a front shell (6) and backshells (12, 12) that nest one with the other, short anchoring flanges (90) and long anchoring flanges (91) that interlock in recesses (64) of a strain relief, and walls (54, 55) that interlock at a second location on the backshells (12, 12).

6 Claims, 6 Drawing Sheets

SHIELDING FOR AN ELECTRICAL CONNECTOR

CROSS REFERENCE TO RELATED APPLICATIONS

This application is a continuation in part of application Ser. No. 08/199,346, filed Jan. 16, 1994, which is a continuation of application Ser. No. 08/004,859, filed Jan. 15, 1993, now abandoned.

FIELD OF THE INVENTION

The field of the invention pertains to shielding for a shielded electrical connector, and particularly to shielding for an electrical connector that provides a cable strain relief.

BACKGROUND OF THE INVENTION

There is disclosed in U.S. Pat. No. 5,158,481, a shielded electrical connector comprising; a terminal support block, contact terminals supported on the block for connection to wires, and shielding for the connector comprising; a mating end on a front shell encircling a mating end of the terminal support block, and conductive backshells enveloping the block.

The shielding is effective when electrical continuity is established between the front shell and the backshells. Prior to the invention, the backshells and front shell were assembled by hooks passing through slots in the front shell. Compression beams near the hooks pressed against the front shell to establish electrical continuity between the front shell and the backshells.

The prior known backshells have been constructed with different shapes to fit one within the other. The backshells have been constructed with strain relief portions of different shapes and sizes that enable a first strain relief portion of larger size to securely wrap upon the other strain relief portion of smaller size.

SUMMARY OF THE INVENTION

According to a feature of the invention, conductive backshells are hermaphroditic in construction, meaning that the backshells are of duplicate interlocking construction. Despite their having hermaphroditic construction, the backshells nest one with the other. Accordingly, an advantage of the invention resides in hermaphroditic backshells constructed to nest one with the other and interlock hermaphroditically.

Another feature of the invention resides in hermaphroditic strain relief portions on shielding for an electrical connector. Despite their having hermaphroditic constructions, the strain relief portions securely interlock over an electrical cable. Accordingly, an advantage of the invention resides in shielding for an electrical connector having strain relief portions constructed to interlock hermaphroditically.

DESCRIPTION OF THE DRAWINGS

Embodiments of the invention will now be described, by way of example, with reference to the accompanying drawings, according to which.

DETAILED DESCRIPTION

Figure 1:
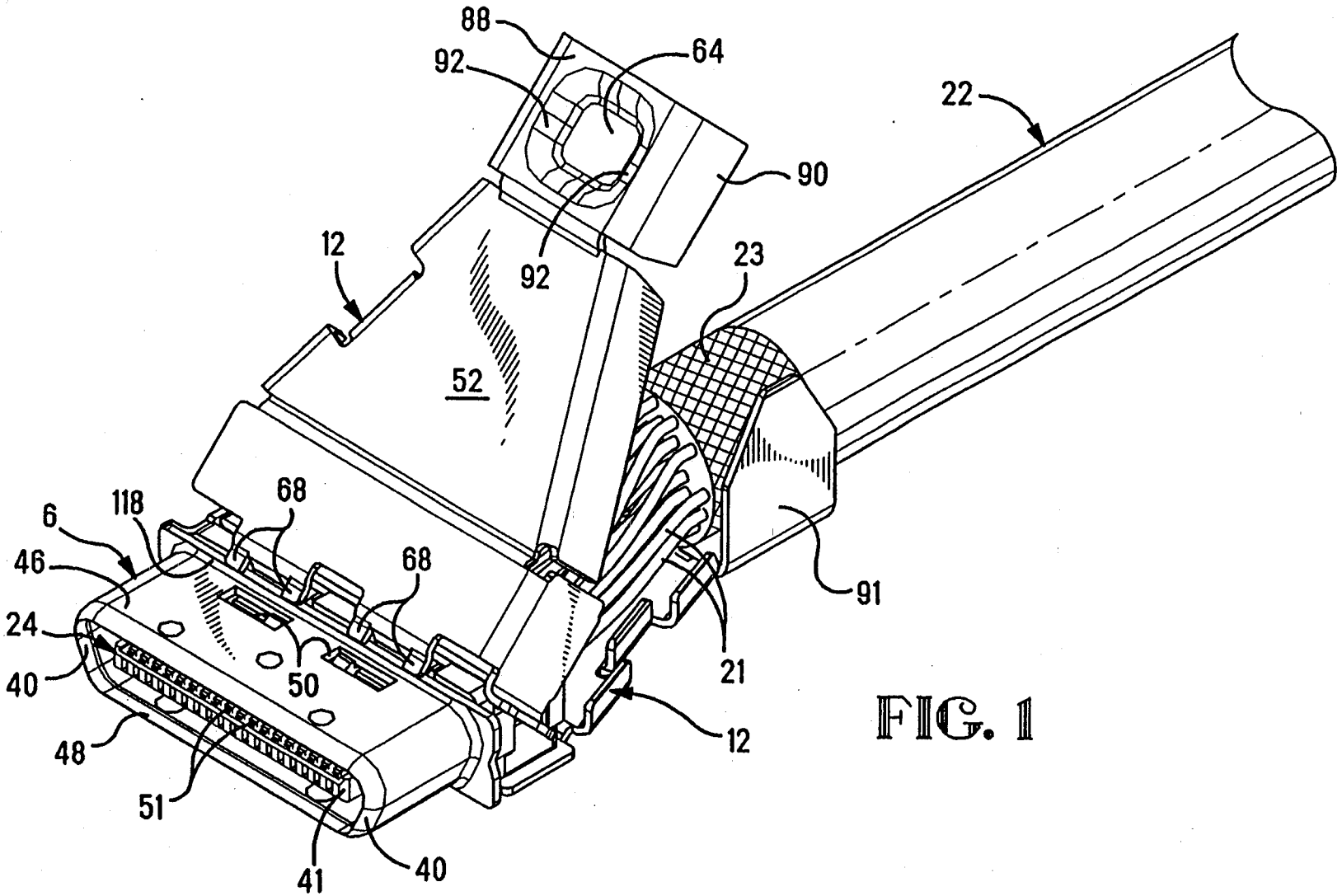
FIG. 1 a perspective view of a shielded electrical connector with parts partially assembled to one another and partially enveloping an electrical connector and an electrical cable.
Figure 2:
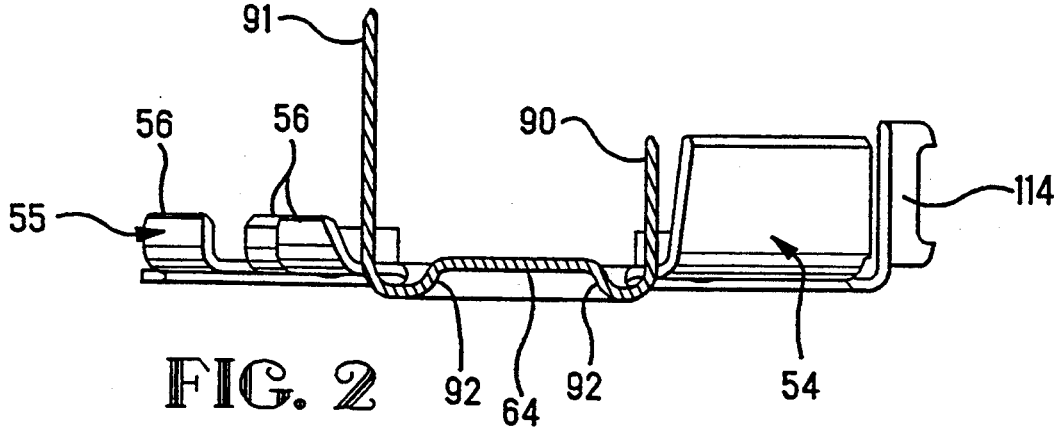
FIG. 2 is a section view taken along line 2—2 of FIG. 6.
Figure 3:
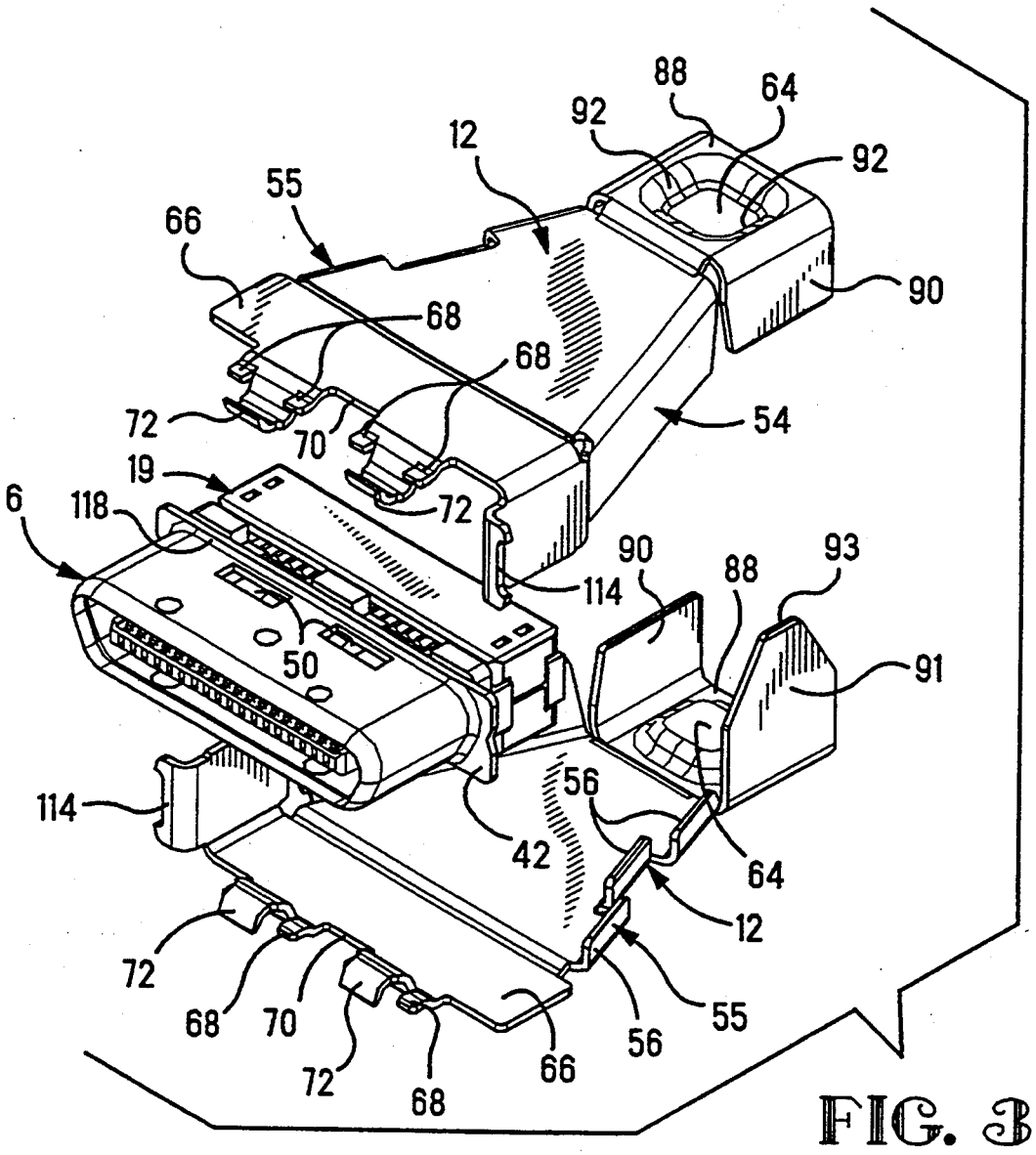
FIG. 3 is a perspective view of the connector shown in FIG. 1 with parts separated from one another.

With reference to FIGS. 1, 2 and 3, a shielded plug type connector 19 comprises an insulative cable terminating section, not shown, for terminating insulated wires 21 of a shielded multiple wire cable 22, and an insulative plug connector section 24 projecting forwardly for mating with a shielded receptacle type connector, not shown. The plug connector section 24 includes a forwardly protruding terminal support block 41 supporting multiple contact terminals 51 having wire terminating portions, not shown, for connection to the wires 21.

Conductive electrical shielding is provided by a unitary drawn metal front shell 6 and an upper metal backshell 12 and a lower metal backshell 12, the backshells 12 being of unitary construction, and being duplicates of each other. The shell 6 defines a cavity encircled by an upper wall 46 and a lower wall 48 and sidewalls 40 that are angled toward each other. Laterally extending slots 50 are provided in the walls 46 and 48 adjacent to a back lip providing a strip shaped bearing member 118 bridging across the back of the slots 50. A plate 66 is offset from the plane of the wall 52 and extends forwardly. A pair of forward extending tabs 68 project from a front edge 70 of the plate 66. A curved, pivot hook 72 projects from the forward edge 70 between the tabs 68.

Each backshell 12 is of unitary construction stamped and formed from sheet metal. The backshell 12 comprises a relatively forward wall 52 and depending sidewall sections 54, 55 providing a channel. The channel is inverted on the upper backshell 12. At a rear of the backshell 12, projects a cable strain relief member comprising a rear wall 88. A recess 64 is formed as a deep depression in the wall 88. An outward projecting, L-shaped flange 114 extending along a lateral side on said first sidewall section on each backshell 12 is engaged behind a laterally projecting flange 42 on the rear of the drawn front shell 6. Further details of the front shell 6 and of the connector 19 are disclosed in U.S. Ser. No. 955,554, filed Oct. 1, 1992, now abandoned.

With reference to the Figures, further details of the backshells 12 will now be described. Each backshell 12 is constructed as a duplicate of the other. Accordingly each element of construction of one backshell 12 is duplicated on the other backshell 12, such that, certain ones of such elements of construction on one backshell 12 interlock with the other backshell 12 to provide hermaphroditic interlocking. Each backshell 12 comprises; at least one first, shorter anchoring flange 90 extending laterally along one side of the rear wall 88, and at least one second, longer anchoring flange 91 extending laterally along another side of the rear wall 88. The first anchoring flanges 90 of the opposed backshells 12, 12 receive the cable 22 therebetween. Each second anchoring flange 91 of each backshell 12 extends along an exterior of the first anchoring flange 90 of the opposed backshell 12. The backshells 12, 12 thereby nest one with the other enveloping the cable 22.

A curved rim having curved sections 92 on each recess 64 curve inwardly to the recess 64. Each anchoring flange 90, 91 being beside one of the curved sections 92 on the same backshell 12.

In FIG. 3, each shorter anchoring flange 90 is beside one of the curved sections 92 of the same backshell 12, and each longer anchoring flange 91 is beside a second of the curved sections 92 of the same backshell 12, and the second of the curved sections 92 of the same backshell 12 is opposite the shorter anchoring flange 90 of the opposed backshell 12.

In an embodiment shown in FIGS. 8-13, multiple flanges 90 and 91 are along both lateral sides of the wall 88. The flanges 90 and 91 on the same lateral side alternate with one another along a row of serially arranged flanges 90, 91, with alternate flanges 90, 91 being offset to alternate sides of an imaginary plane intersecting spaces between the alternate flanges 90, 91. On one lateral side, there is at least one inward offset flange 90 and two outward offset flanges 91. On the other lateral side, there is at least one inward offset flange 91 and two outward offset flanges 90. The flanges 90 and 91 are interleaved with the flanges 90, 91 of an opposed backshell 12, nesting the backshells 12, 12 one with the other.

The anchoring flanges 90, 91 encircle conductive braid 23 of the cable 22. The second anchoring flanges 91 curve against the first of the curved sections 92 on an opposed backshell 12, and toward the recess 64 of the opposed backshell 12. Each second anchoring flange 91 overlaps the curved section 92 on the rear wall 88 of the opposed backshell 12 and enters the recess 64 of the opposed backshell 12 interlocking hermaphroditically the opposed backshells 12, 12 over the cable. The tip of each flange 91 is radiuses at 93 to curl and bend in a curving manner against the curved section 92. Each flange 91 bends from the tangent point of the radius to curve in a direction directly into the curved section 92 inside of the recess 64.

Figure 5:
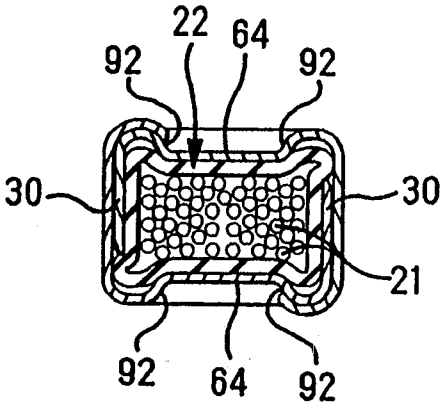
FIG. 5 is a section view taken along line 5—5 of FIG. 4.
Figure 4:
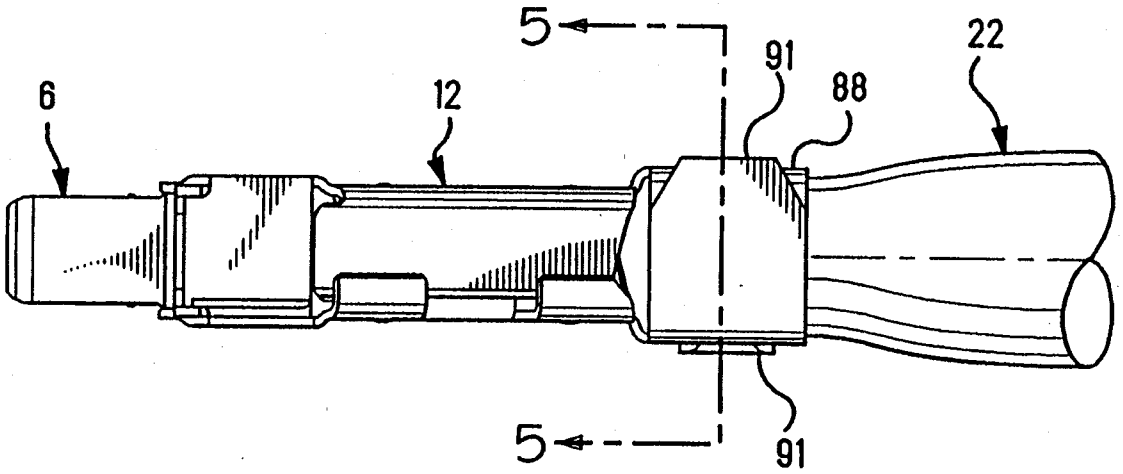
FIG. 4 is a side view of the connector as shown in FIG. 1 with parts assembled and enveloping an electrical connector and an electrical cable.
Figure 6:
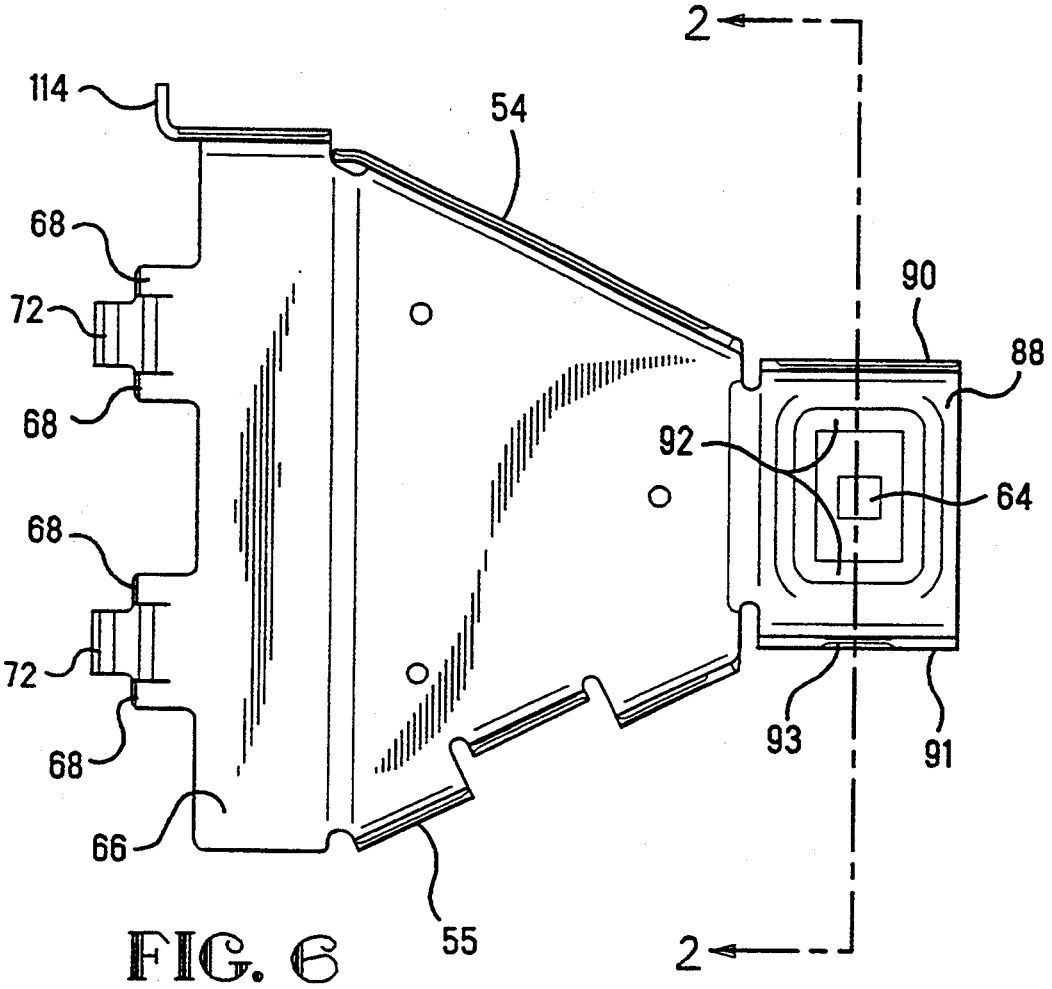
FIG. 6 is a top plan view of a backshell.
Figure 7:
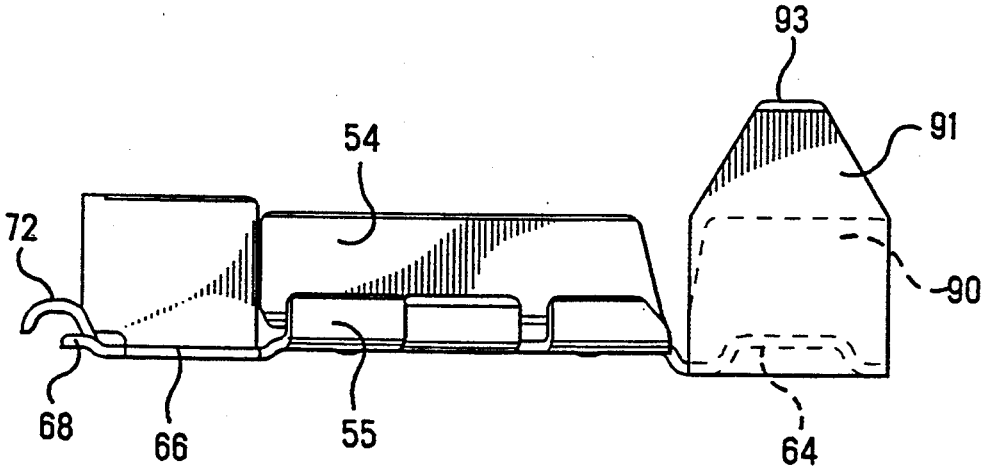
FIG. 7 is a side view of the backshell shown in FIG. 6.
Figure 8:
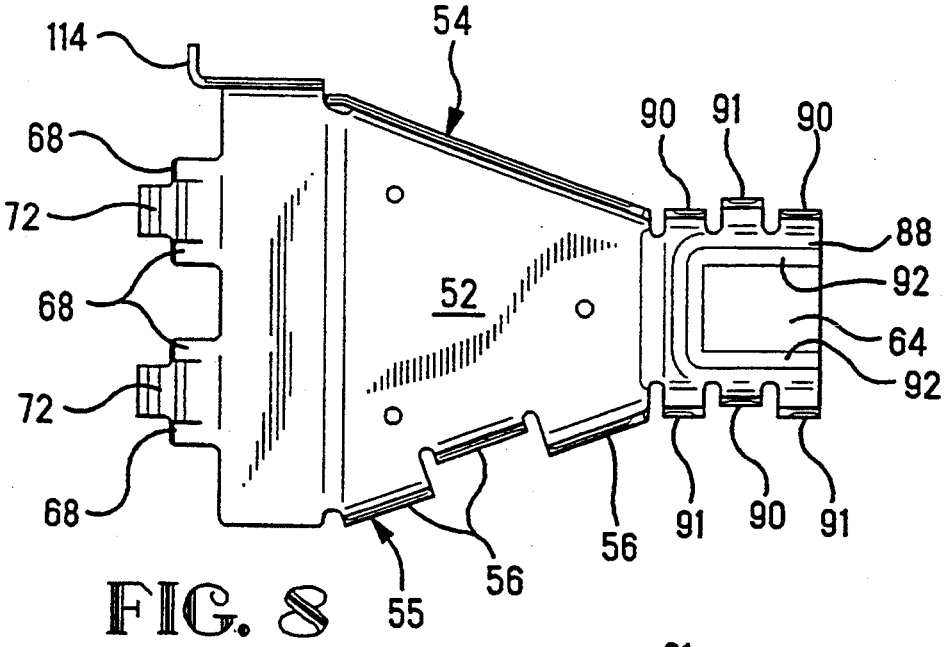
FIG. 8 is a view similar to FIG. 6 of another backshell.
Figure 9:
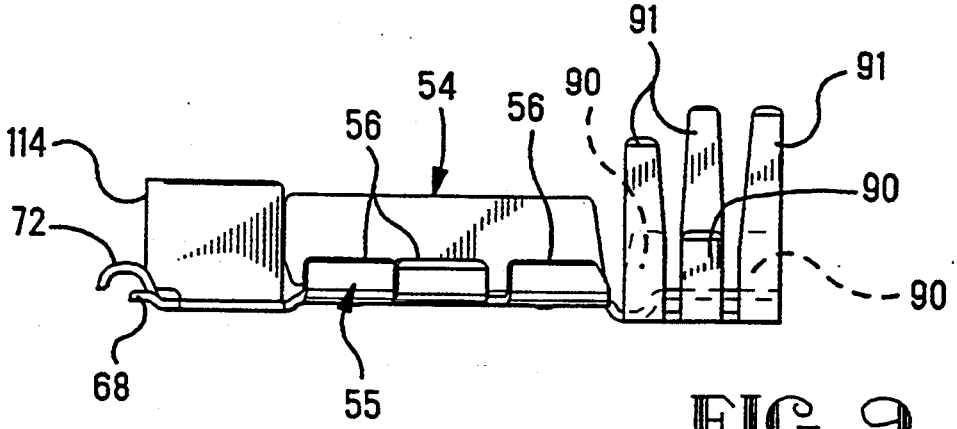
FIG. 9 is a view similar to FIG. 7 of the backshell shown in FIG. 8.
Figure 10:
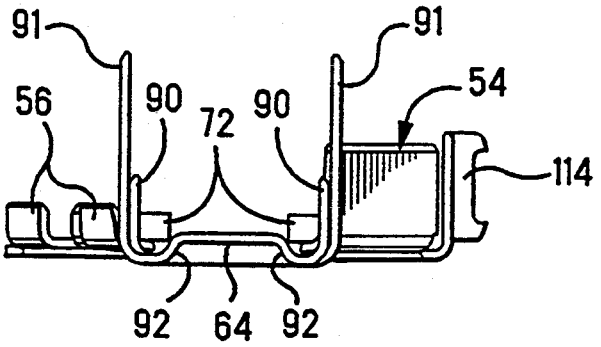
FIG. 10 is a view similar to FIG. 2 of the backshell shown in FIG. 8.
Figure 11:
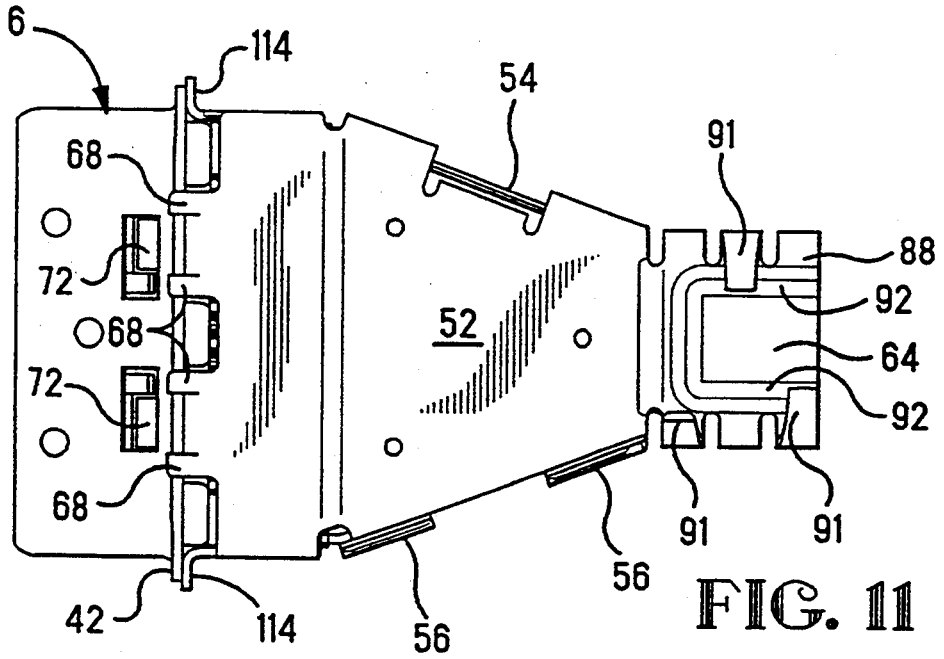
FIG. 11 is a top plan view of two backshells as shown in FIG. 8, assembled together, absent a cable.
Figure 12:
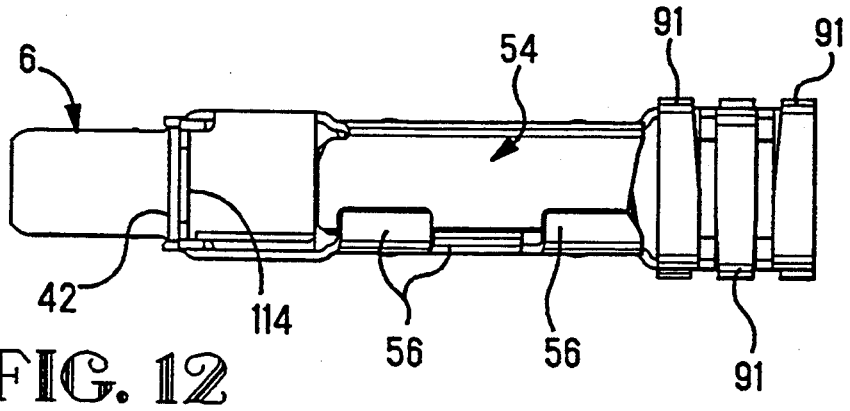
FIG. 12 is a view similar to FIG. 4 of the backshells shown in FIG. 11.
Figure 13:
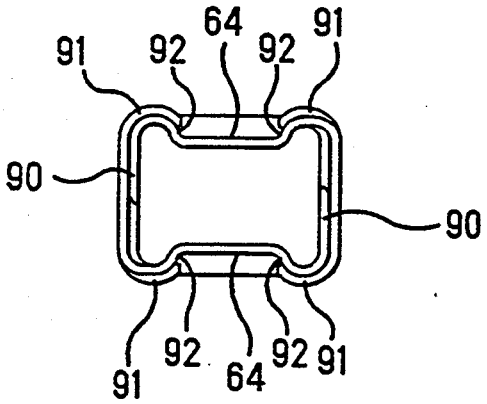
FIG. 13 is a view similar to FIG. 5, absent a cable, of the backshells shown in FIG. 11.

With reference the FIG. 5, the recesses 64 indent the cable 22 therebetween to a smaller volume to provide strain relief, and to compress against the braid 23 and provide an electrical ground connection. Another advantage of the invention resides in each hermaphroditic backshell 12 contributing equally to indentation of the cable 22 to provide strain relief, accomplished by, the first anchoring flanges 90, FIG. 5, indenting the cable 22 therebetween, and the recesses 64 indenting the cable 22 therebetween to a smaller volume to provide such strain relief.

With reference to FIGS. 1–4, an advantage resides in the backshells 12, 12 that hermaphroditically interlock at a second location. Each backshell 12 further comprises, the sidewall sections 54, 55 that extend along lateral sides of the wall 52 forward of the rear wall 88. One of the sidewall sections 54 is between the flange 90 and the flange 114. At least one of the sidewall sections 55 on each backshell 12 is divided into a row of serially arranged fingers 56 with alternate fingers 56 being offset to alternate sides of an imaginary plane intersecting spaces between the alternate fingers 56. In the embodiment there is at least one inward offset finger 56 and two outward offset fingers 56. The sidewall section 55 of an opposed backshell 12 is interleaved with the fingers 56 when said side wall section 55 is inserted along the imaginary plane, and in the spaces between the fingers 56. The fingers 56 are received on opposite sides of the sidewall section 55 of an opposed backshell 12, nesting the backshells 12, 12 one with the other, and interlocking hermaphroditically the opposed backshells 12 at a second location. The sidewall sections 54 will bridge across to the opposed backshell 12, enveloping the cable 22 and a rear portion of the connector 19. The cable 22 extends between the opposed backshells 12, 12. The flanges 114 of the opposed backshells 12, 12 project forwardly of the fingers 56, while the sidewalls 54 are received by the fingers 56, to extend the flanges 114, 114 forwardly on opposite sides of the opposed backshells 12, 12. The flanges 114, 114 divide the forces that are exerted, when the flanges 114 engage the flange 42 on the front shell 6.

The sidewall sections 54, 55 on each backshell 12 extend diagonally from back to front, the diagonal orientation resisting shifting of the sidewall sections 54 along the imaginary plane and relative to the fingers 56.

With reference to FIG. 3, the backshell 12 is hooked and attached to the front shell 6 and envelops the connector 41. The backshell 12 is hooked to the front shell 6 and is pivoted toward the opposed backshell 12 to envelop the connector 19. The anchoring flanges 91 are inwardly bent to wrap over the wall 88 of the opposed backshell 12 and the cable 22, FIG. 2, providing a strain relief for the cable 22, and connecting the backshells 12, 12.

An advantage of the invention resides in shielding backshells 12 that nest one with the other and interlock hermaphroditically. Another advantage resides in shielding backshells with strain relief portions that nest one with the other and interlock hermaphroditically. Another advantage resides in shielding shells that interlock hermaphroditically in first and second locations.

Other embodiments, objects and advantages of the invention are intended to be covered by the spirit and scope of the appended claims.

I claim:

1. Shielding for an electrical connector comprising: a conductive front shell and conductive top and bottom backshells constructed to envelop an electrical connector and an electrical cable; each said top and bottom backshells comprising, a rear wall and a recess forming a deep depression in the rear wall, a shorter anchoring flange extending laterally along one side of the rear wall, and a longer anchoring flange extending laterally along another side of the rear wall; the shorter anchoring flanges on the top and bottom backshells receiving the cable therebetween, the longer anchoring flanges on the top and bottom backshells extending along exteriors of the shorter first anchoring flanges on the top and bottom backshells and curving toward the recesses of the top and bottom backshells, the longer anchoring flanges overlapping corresponding rear walls of the top and bottom backshells and entering corresponding recesses of the top and bottom backshells hermaphroditically interlocking the top and bottom backshells over the cable; sidewall sections extending laterally along sides of a wall on each of the top and bottom backshells forward of the rear wall; and the sidewall sections on each of the top and bottom backshells being divided into fingers received on opposite sides of the sidewall section of the top and bottom backshells hermaphroditically interlocking the top and bottom backshells.

2. Shielding as recited in claim 1, and further comprising: the shorter anchoring flanges indenting the cable therebetween, and the recesses indenting the cable therebetween to a smaller volume to provide strain relief.

3. Shielding as recited in claim 1, and further comprising: curved sections on the rear wall of each backshell being curved inwardly to the recess, the shorter anchoring flange being beside a first of the curved sections of the same backshell, the longer anchoring flange being beside a second of the curved sections of the same backshell.

4. Shielding for an electrical connector comprising: a conductive front shell and top and bottom unitary, duplicate, conductive backshells constructed to envelop an electrical connector and an electrical cable; each said top and bottom backshells comprising, first and second sidewall sections projecting along lateral sides of a forward wall, the first sidewall sections of said top and bottom backshells being duplicates of each other, the second sidewall sections of said top and bottom backshells being duplicates of each other, the first sidewall sections interlocking with the second sidewall sections of the corresponding top and bottom backshells, rear walls on the top and bottom backshells, a shorter anchoring flange and a longer anchoring flange on each of the rear walls, the shorter anchoring flanges being duplicates of each other, the longer anchoring flanges being duplicates of each other, both of said top and bottom backshells being interlocked by the longer anchoring flanges on both of said top and bottom backshells overlapping the rear walls on respective top and bottom backshells, and each of said top and bottom backshells having a single L-shaped flange extending along a lateral side on said first sidewall section.

5. Shielding as recited in claim 4, and further comprising: a recess bounded by sides in each of said rear walls, the longer anchoring flanges of both said rear wall entering the recesses in respective rear walls.

6. Shielding as recited in claim 4, and further comprising: curved sections on the rear wall of each backshell being curved inwardly to the recess, the shorter anchoring flange being beside a first of the curved sections of the same backshell, the longer anchoring flange being beside a second of the curved sections of the same backshell.

* * * * *